US007640626B2

(12) United States Patent
Oh

(10) Patent No.: US 7,640,626 B2
(45) Date of Patent: Jan. 5, 2010

(54) SUCTION BRUSH OF VACUUM CLEANER FOR BOTH VACUUM CLEANING AND STEAM CLEANING

(75) Inventor: Jang-Keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 137 days.

(21) Appl. No.: 11/903,604

(22) Filed: Sep. 24, 2007

(65) Prior Publication Data

US 2008/0282490 A1 Nov. 20, 2008

(30) Foreign Application Priority Data

May 15, 2007 (KR) ..... 10-2007-0047078

(51) Int. Cl.
*A47L 5/10* (2006.01)

(52) U.S. Cl. ..... 15/387; 15/385; 15/321

(58) Field of Classification Search ..... 15/385, 15/387, 375–377, 379, 380, 321, 322
See application file for complete search history.

(56) References Cited

U.S. PATENT DOCUMENTS 6,792,648 B2 * 9/2004 Lee ..... 15/377
6,823,558 B2 * 11/2004 Lee ..... 15/391
6,842,941 B2 * 1/2005 Lee ..... 15/385
2003/0221281 A1 * 12/2003 Oh ..... 15/387
2005/0223522 A1 * 10/2005 Song et al. ..... 15/387
2007/0157422 A1 * 7/2007 Oh et al. ..... 15/387

FOREIGN PATENT DOCUMENTS

KR 20-2003-0008207 3/2003
KR 20-2006-0006026 3/2006

* cited by examiner

*Primary Examiner*—Dung Van Nguyen
(74) *Attorney, Agent, or Firm*—Ohlandt, Greeley, Ruggiero & Perle, L.L.P.

(57) ABSTRACT

A suction brush of a vacuum cleaner for both vacuum cleaning and steam cleaning is provided. The suction brush includes a brush main body connected to a cleaner main body; a steam generating unit for heating water being supplied from a water storage tank mounted on the brush main body and spraying steam generated by heating the water on the surface to be cleaned; a turbine fan, installed in the brush main body, for generating a rotating force by the drawn-in air that flows into the brush main body; a power transfer unit for being driven by the rotating force of the turbine fan; and at least one pair of duster rotating plates, arranged on a lower part of the suction brush, for being rotated by power being transferred through the power transfer unit.

12 Claims, 8 Drawing Sheets

SUCTION BRUSH OF VACUUM CLEANER FOR BOTH VACUUM CLEANING AND STEAM CLEANING

CROSS-REFERENCE TO RELATED APPLICATIONS

This application claims the benefit under 35 U.S.C. §119 of Korean Patent Application No. 10-2007-0047078, filed May 15, 2007, in the Korean Intellectual Property Office, the entire disclosure of which is incorporated herein by reference.

BACKGROUND OF THE INVENTION

1. Field of the Invention

The present disclosure relates generally to a vacuum cleaner for both vacuum cleaning and steam cleaning. More particularly, the present disclosure relates to a suction brush, which can perform both vacuum cleaning using a suction force and steam cleaning including steam spray on a surface to be cleaned and wiping of the steamed surface.

2. Description of the Related Art

Generally, a vacuum cleaner, and particularly, a canister type vacuum cleaner, is composed of a main body and a brush, which are separably connected together through a connection tube and a flexible hose, and performs cleaning so as to draw in dust and other foreign materials through the brush, along with the operation of a motor, a filter, and so forth, installed in the main body.

A conventional vacuum cleaner collects dust existing on a surface to be cleaned through a suction brush by using a suction force generated by a suction motor installed in the main body, filters air drawn-in with the dust, and discharges the filtered gas to outside.

However, the vacuum cleaner as described above performs cleaning through the suction only, and thus it is difficult to remove dirt or stains stuck on the floor, tile, window, and so forth, using the vacuum cleaner. Accordingly, it is required to directly wipe the dirty region with a wed duster in addition to the vacuum cleaning using the vacuum cleaner, and this causes a user inconvenience.

In order to solve this problem, Korean Patent Registration No. 470320 discloses a steam cleaner that has a vacuum cleaning function and performs both vacuum suction cleaning and steam cleaning at a time. This conventional cleaner for both the steam cleaning and vacuum cleaning is provided with a vacuum suction cleaning part installed in a front portion of the cleaner to draw-in and collect dust, and a steam cleaning part installed in the rear portion of the cleaner to directly spray steam on a duster that rotates to wipe the dirty floor.

However, according to the conventional cleaner, duster rotating plates are inserted into the bottom surface of the brush. In order to attach/detach dusters to/from the rotating plates, a user must turn the heavy brush over so that the bottom surface of the brush is turned upward and then detach the dusters from the rotating plates.

Also, a water storage tank for supplying water to a steam generating means is non-detachably buried in the brush. Thus, a user can see the water remaining in the water tank only through a narrow inlet of the water tank, when the cap of the tank is removed. Accordingly, it is difficult for the user to accurately grasp the amount of water remaining in the water tank and to recognize when to refill the water tank.

In addition, since the conventional cleaner is of a water tank heating type, a long preheating time for preheating the water, e.g., at least two to four minutes, is required to perform the steam cleaning. Also, since the water always remains in the heater for generating the steam, the heater may corrode or a steam spray nozzle of the heater may be choked due to mold forming in the remaining water.

In addition, any safety device for interrupting the power supply to the heater when the heater is overheated is not provided, and this may cause the damage of a product or the occurrence of fire due to the overheat of the heater.

SUMMARY OF THE INVENTION

Embodiments of the present disclosure have been developed in order to substantially solve the above and other problems associated with the conventional arrangement and provide the objectives listed below. An aspect of embodiments of the present disclosure is to provide a suction brush of a vacuum cleaner for both vacuum cleaning and steam cleaning that can improve the whole function of the vacuum cleaner.

The foregoing and other objects and advantages are substantially realized by providing a suction brush of a vacuum cleaner for both vacuum cleaning and steam cleaning, according to embodiments of the present disclosure, which comprises a brush main body, connected to a cleaner main body having a suction motor and a dust collecting unit, for drawing-in dust existing on a surface to be cleaned together with air by using a suction force generated by the suction motor and guiding the drawn-in dust and air to the dust collecting unit; a steam generating unit for heating water being supplied from a water storage tank mounted on the brush main body and spraying steam generated by heating the water on the surface to be cleaned; a turbine fan, installed in the brush main body, for generating a rotating force by the drawn-in air that flows into the brush main body; a power transfer unit for being driven by the rotating force of the turbine fan; and at least one pair of duster rotating plates, arranged on a lower part of the suction brush, for being rotated by power being transferred through the power transfer unit; wherein each of the at least one pair of duster rotating plates has a part that is detachably attached to the power transfer unit to attach/detach a duster to/from a bottom surface of the duster rotating plate.

The at least one pair of duster rotating plates may be arranged to project over a rear outer part of the brush main body, so as to facilitate separation of projection parts of the pair of duster rotating plates from the brush main body when a user steps on the projection parts.

The power transfer unit may comprise a pair of worm gears extendingly formed on both sides of a shaft of the turbine fan; and worm wheels meshed with the worm gears, respectively.

The pair of duster rotating plates may be provided with a pair of coupling protrusions formed on their upper surfaces and detachably coupled to coupling holes formed on the pair of worm wheels. First and second non-slip parts having screw threads may be formed on outer peripheries of the pair of coupling protrusions, respectively, and third and fourth non-slip parts corresponding to the first and second non-slip parts of the coupling protrusions may be formed on inner peripheries of the coupling holes formed on the pair of worm wheels, respectively, wherein the first and second non-slip parts are meshed with the third and fourth non-slip parts, respectively, when the coupling protrusions are coupled to the first and second worm wheels.

The coupling protrusions of the pair of duster rotating plates may be made of an elastic material, and the diameter D2 of the coupling protrusions of the pair of duster rotating plates may be larger than the diameter D1 of the coupling holes so that the pair of coupling protrusions are pressedly coupled to the coupling holes of the pair of worm wheels.

A part of the water storage tank may be made of a transparent material so that its interior can be seen in a state that the water storage tank is mounted on the brush main body. Accordingly, a user can grasp an amount of water remaining in the water storage tank.

The steam generating unit may comprise a micro-pump, connected to the water storage tank, for micro-pumping the water stored in the water storage tank; and a heater unit for steaming the water being supplied from the micro-pump by instantaneously heating the water and spraying the steam on the surface to be cleaned through a spray nozzle.

The heater unit may comprise an upper case having an inflow tube formed thereon to receive the water being supplied from the micro-pump; and a lower case detachably coupled to the upper case and having a heater that is arranged under an instantaneous heating region of the heater unit to heat the water. Here, the instantaneous heating region may be formed to be continuously inclined downward as the water in the inflow tube flows from a water supply point to a water spray point by gravity.

Accordingly, the water being supplied from the micro-pump may be instantaneously heated, and thus the preheating time can be greatly reduced in comparison to the conventional vacuum cleaner for both vacuum cleaning and steam cleaning. In this case, the instantaneous heating region may be formed as a "U"-shaped guide groove to secure the largest heating area corresponding to a size of the heater unit, and the heater may be formed in a "U" shape along the instantaneous heating region.

The heater unit may further comprise a temperature control device for intercepting a power being supplied to the heater unit if a sensed temperature of the heater unit is higher than a predetermined temperature.

The suction brush of a vacuum cleaner according to embodiments of the present disclosure may further comprise a bimetal device for preventing overheat of the heater unit when the temperature control device is out of order.

The section brush of a vacuum cleaner according to embodiments of the present disclosure may further comprise a temperature fuse for intercepting the power being supplied to the heater unit to prevent the overheat of the heater unit when the temperature control device and the overheat preventing device are out of order. Consequently, through a multistage safety device, the overheat of the heater unit can be surely prevented.

BRIEF DESCRIPTION OF THE DRAWINGS

The above aspects and features of embodiments of the present disclosure will become more apparent by describing certain exemplary embodiments of the present disclosure with reference to the accompanying drawings, in which.

Throughout the drawings, like reference numerals will be understood to refer to like parts, components and structures.

DETAILED DESCRIPTION OF EXEMPLARY EMBODIMENTS

Figure 1:
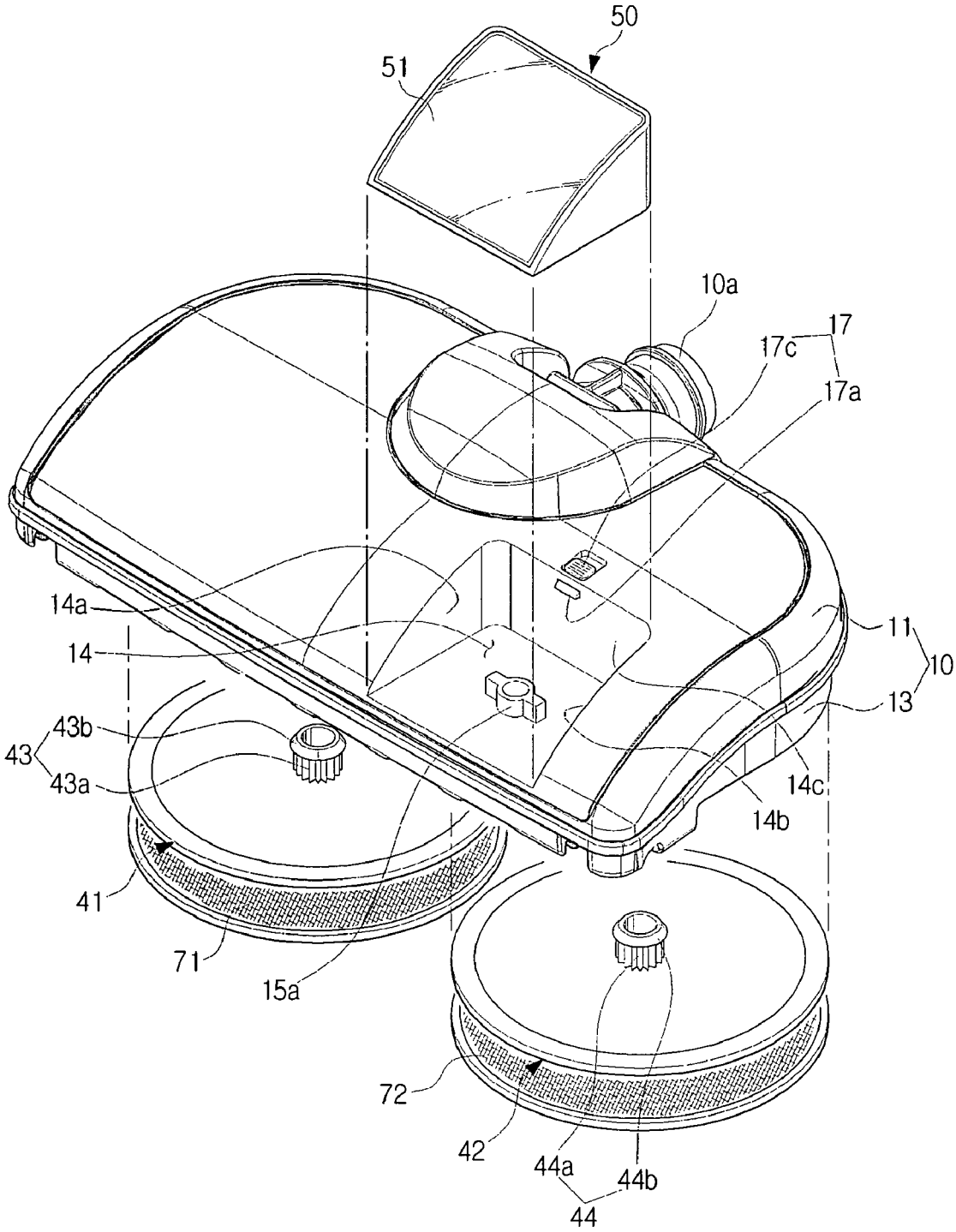
FIG. 1 is an exploded perspective view of a suction brush of a vacuum cleaner for both vacuum cleaning and steam cleaning according to an exemplary embodiment of the present disclosure.

Exemplary embodiments of the present disclosure will now be described in detail with reference to the annexed drawings. In the drawings, the same elements are denoted by the same reference numerals throughout the drawings. In the following description, detailed descriptions of known functions and configurations incorporated herein have been omitted for conciseness and clarity.

Figure 2:
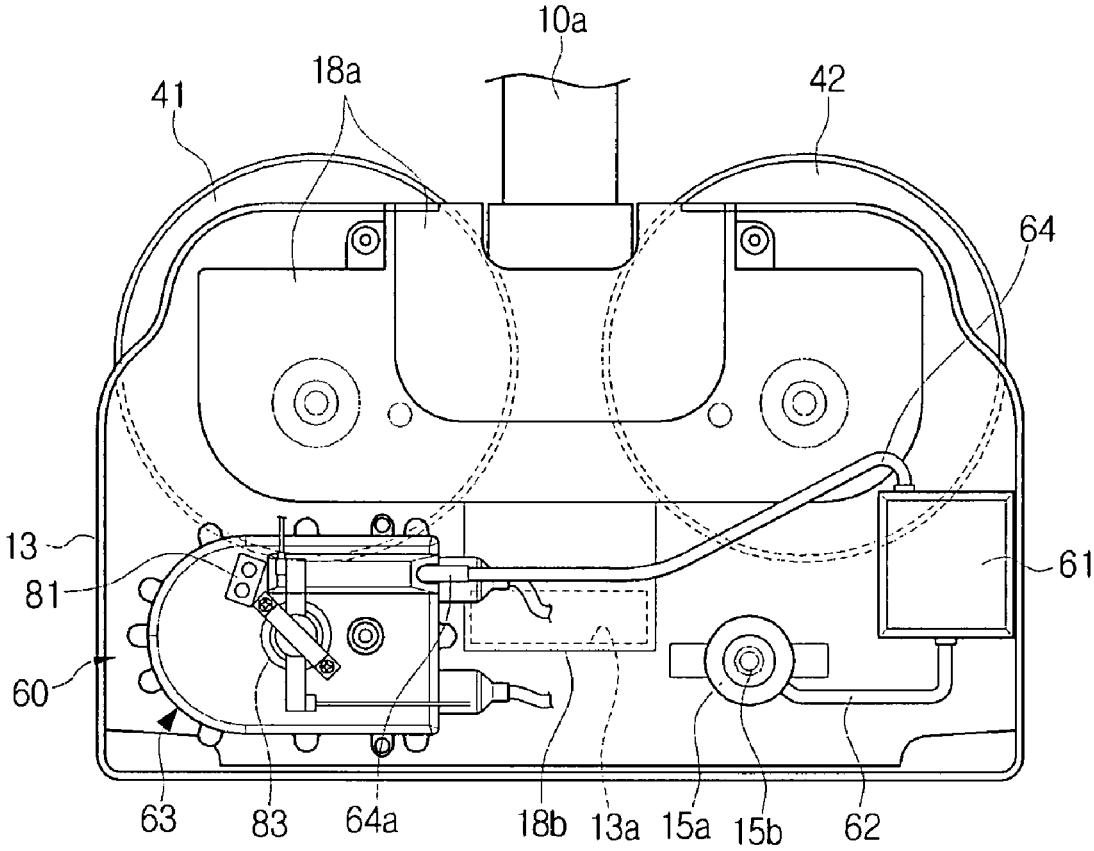
FIG. 2 is a schematic plan view illustrating the inside of the suction brush illustrated in FIG. 1.

FIG. 1 is an exploded perspective view of a suction brush of a vacuum cleaner for both vacuum cleaning and steam cleaning according to an exemplary embodiment of the present disclosure. FIG. 2 is a schematic plan view illustrating the inside of the suction brush illustrated in FIG. 1, and FIG. 3 is a schematic perspective view illustrating a turbine fan and a power transfer unit installed inside a cover illustrated in FIG. 2.

Figure 3:
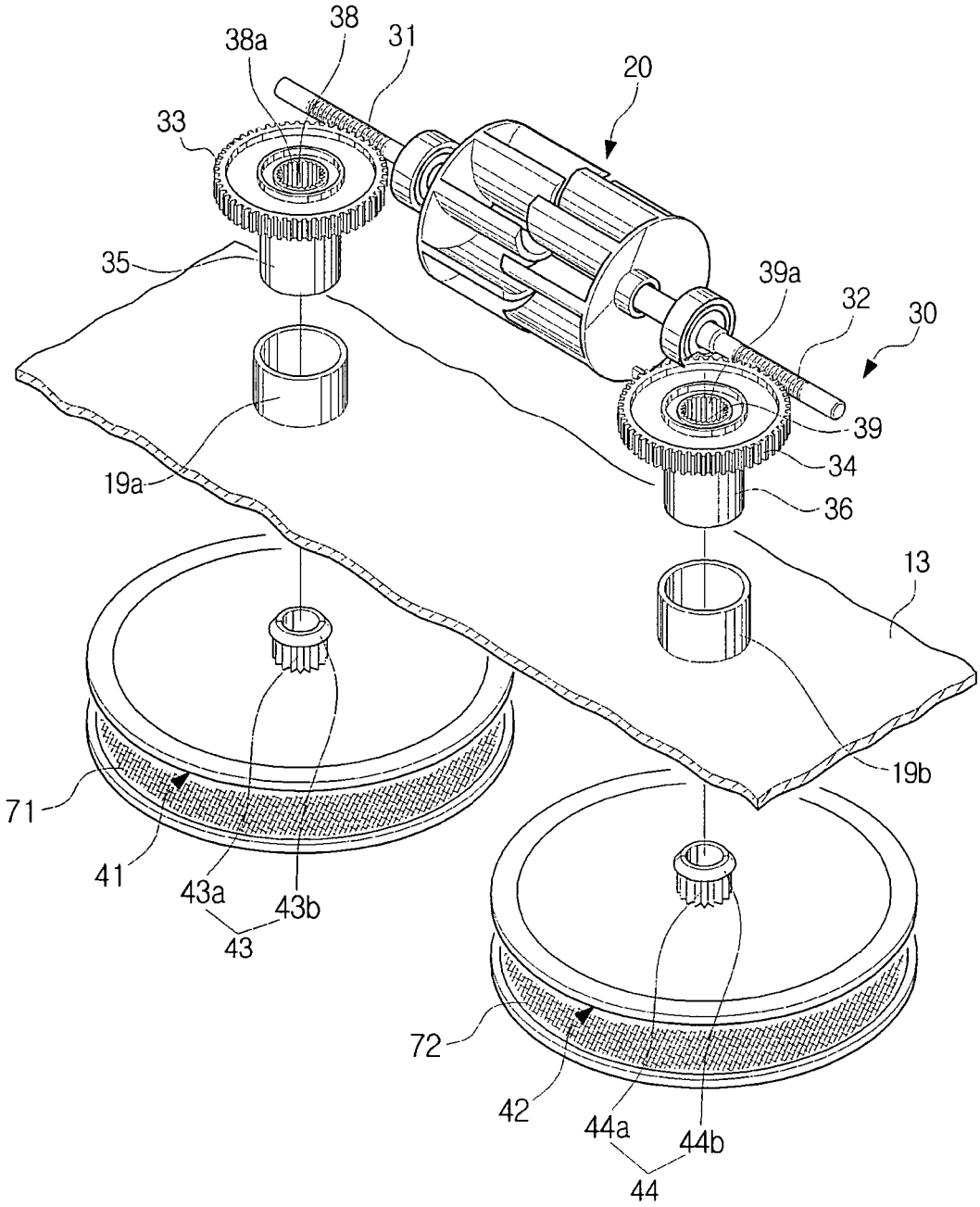
FIG. 3 is a schematic perspective view illustrating a turbine fan and a power transfer unit installed inside a cover illustrated in FIG. 2.

The suction brush of a vacuum cleaner for both vacuum cleaning and steam cleaning according to an exemplary embodiment of the present disclosure, as illustrated in FIGS. 1 to 3, comprises a brush main body 10, a turbine fan 20, a power transfer unit 30, first and second duster rotating plates 41 and 42, a water storage tank 50, a steam generating unit 60, a temperature control device 81, an overheat preventing device 83, and a temperature fuse 85.

The brush main body 10 comprises an upper main body 11 and a lower main body 13, and a connection tube 10*a* that is connected to a suction port 13*a* is rotatably coupled to the rear part of the brush main body 10. The connection tube 10*a* is connected to a connection tube (not illustrated) connected to a cleaner main body (not illustrated) in which a suction motor (not illustrated) and a dust-collecting unit (not illustrated) are installed.

The upper main body 11 is detachably attached to the lower main body 13, and serves to protect various components installed in the lower main body 13. In addition, the upper main body 11 has an accommodating groove 14 formed thereon to accommodate the water storage tank 50, and the accommodating groove 14 has side walls 14*a* and 14*b* that are in close contact with both side surfaces of the water storage tank 50 and a rear wall 14*c* that is in close contact with a rear surface of the water storage tank 50.

The lower main body 13 has the suction port 13*a* formed on a bottom surface thereof to drawn-in air together with dust existing on a surface to be cleaned, and first and second duster rotating plates 41 and 42 are provided in the rear of the suction port 13*a*. In addition, the lower main body 13 is provided with the turbine fan 20, the power transfer unit 30, and the steam generating unit 60 installed therein. In the lower main body 13, a first cover 18*a* for covering the turbine fan 20 and the power transfer unit 30 to accommodate them separately from the steam generating unit 60. In front of the first cover 18*a*, a second cover 18*b* for guiding the air flow from the suction port 13*a* to the first cover 18*a* is installed. The first and second covers 18*a* and 18*b* limit a suction path to the shortest distance between the suction port 13*a* and the connection part 10*a* so that the dust and air drawn-in from the surface to be cleaned to the suction port 13*a* are guided to the connection part 10*a* with a minimum pressure loss.

The turbine fan 20 is rotatably installed on the suction path of the lower main body 13 that is adjacent to the connection part 10*a*, and is rotated by the drawn-in air flowing into the connection part 10*a*. In addition, the turbine fan 20 serves as a rotation power source of the first and second duster rotating plates 41 and 42.

The power transfer unit 30 comprises first and second worm gears 31 and 32 and first and second worm wheels 33 and 34, and serves to transfer the rotating force of the turbine fan 20 to the first and second duster rotating plates 41 and 42. In this case, the first and second worm gears 31 and 32 are fixed to both sides of a shaft of the turbine fan 20, and extend by a specified length along the shaft of the turbine fan 20.

The first and second worm wheels 33 and 34 are meshed with the first and second worm gears 31 and 32, respectively, and first and second rotation support shafts 35 and 36 extendingly formed on the lower parts of the worm wheels 33 and 34 are movably inserted into first and second rotation support protrusions 19*a* and 19*b* formed on the lower main body. Also, first and second coupling holes 38 and 39 formed in the center of the first and second worm wheels 33 and 34 pierce the first worm wheel 33 and the first rotation support shaft 35, and the second worm wheel 34 and the second rotation support shaft 36, respectively. In this case, first and second non-slip parts 38*a* and 39*a* having screw threads are formed on inner peripheries of the coupling holes 38 and 39.

Dusters 71 and 72 are detachably attached to the bottom surfaces of the first and second duster rotating plates 41 and 42, and coupling protrusions 43 and 44 snap-coupled to the coupling holes 38 and 39 of the first and second worm wheels 33 and 34 are formed on the upper surfaces of the first and second duster rotating plates 41 and 42 with a specified length.

Third and fourth non-slip parts 43*a* and 44*a* having screw threads are formed on outer peripheries of the pair of the coupling protrusions 43 and 44 in the same manner as the first and second non-slip parts 38*a* and 39*a* of the coupling holes 38 and 39. When the coupling protrusions 43 and 44 are snap-coupled to the coupling holes 38 and 39, the third and fourth non-slip parts 43*a* and 44*a* of the coupling protrusions 43 and 44 are meshed with the first and second non-slip parts 38*a* and 39*a* of the coupling holes 38 and 39. Accordingly, the first and second duster rotating plates 41 and 42 accurately receive the rotating force of the first and second worm wheels 33 and 34, and thus are rotated together with the first and second worm wheels 33 and 34.

In addition, the coupling protrusion 43 and 44 are provided with snap-coupling parts 43*b* and 44*b* formed on upper ends of the coupling protrusions 43 and 44, of which the diameter is somewhat larger than the diameter of the coupling holes 38 and 39. It is preferable that the coupling protrusions 43 and 44 of the snap-coupling parts 43*b* and 44*b* are made of an elastic material having the elasticity so as to facilitate the attachment/detachment of the coupling protrusions 43 and 44 to/from the coupling holes 38 and 39.

Figure 4:
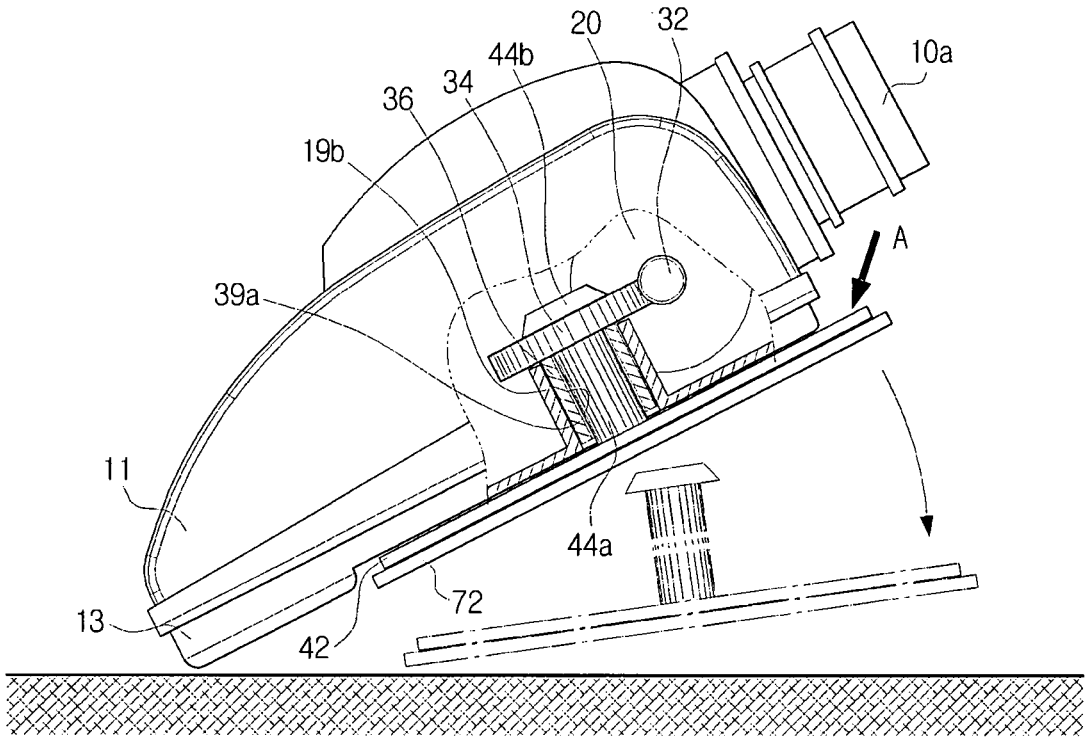
FIG. 4 is a side view of a suction brush of a vacuum cleaner for both vacuum cleaning and steam cleaning according to an exemplary embodiment of the present disclosure.

Further, parts of the first and second duster rotating plates 41 and 42 are projected in the rear of the brush main body 10, and this is to consider that the user's cleaning position is in the rear of the brush main body 10. For example, in order to separate the dusters 71 and 72 from the first and second rotating plates for replacement of the dusters, as shown in FIG. 4, a user can easily separate the coupling protrusions 43 and 44 from the coupling holes 38 and 39 of the first and second worm wheels 33 and 34 by stepping on parts of the first and second duster rotating plates 41 and 42 projected in the rear of the brush main body 10 (as shown by arrow A) in a state that the user lifts up the rear part of the brush main body 10 for a specified distance on the basis of the front part of the brush main body 10.

Figure 5:
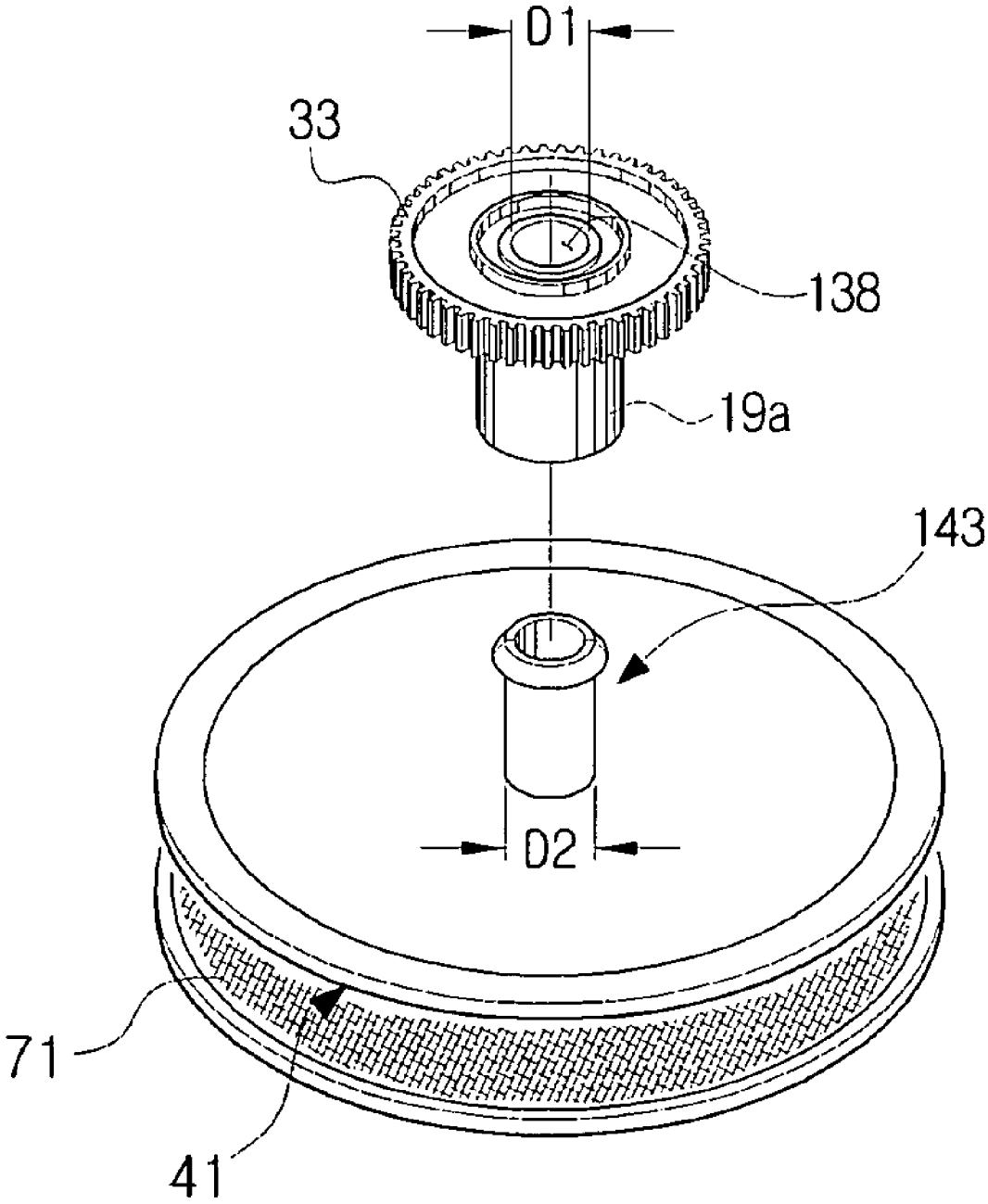
FIG. 5 is a perspective view illustrating another example of a duster support plate and a pinion coupled to each other as illustrated in FIG. 4.

In an alternate embodiment shown in FIG. 5, in order to receive the rotating force from the first and second worm wheels 33 and 34, the first to fourth non-slip parts 38*a*, 39*a*, 43*a*, and 44*a* formed on the coupling holes 38 and 39 and the coupling protrusions 43 and 44 may be omitted. In this embodiment, the coupling protrusion 143 of the first duster rotating plate 41 may be made of an elastic material. In this case, the diameter D2 of the coupling protrusion 143 is somewhat larger than the diameter of the coupling hole 138 of the first worm wheel 33. Accordingly, the coupling protrusion 143 is pressedly coupled to the coupling hole 138, and thus the coupling protrusion 143 can accurately transfer the rotating force to the first and second duster rotating plates 41 and 42 without slipping in the coupling hole 138. Although not illustrated in the drawing, the coupling protrusion of the second duster rotating plate 42 and the coupling hole of the second worm wheel 34 may be formed in the same manner as the coupling protrusion 143 and the coupling hole 138 as described above.

Figure 6:
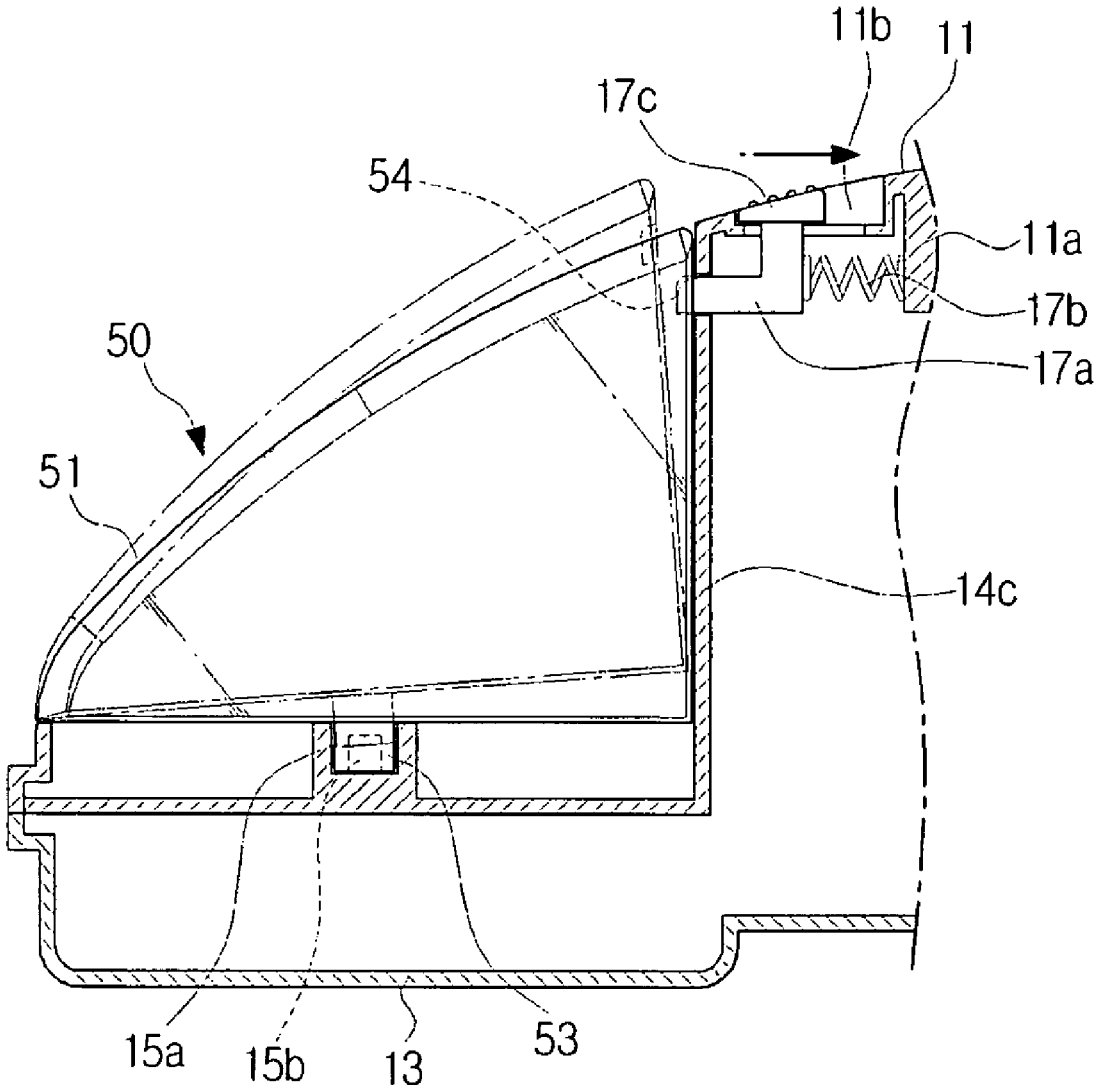
FIG. 6 is a partially enlarged sectional view illustrating a water storage tank detachably attached to a suction brush.
Figure 7A:
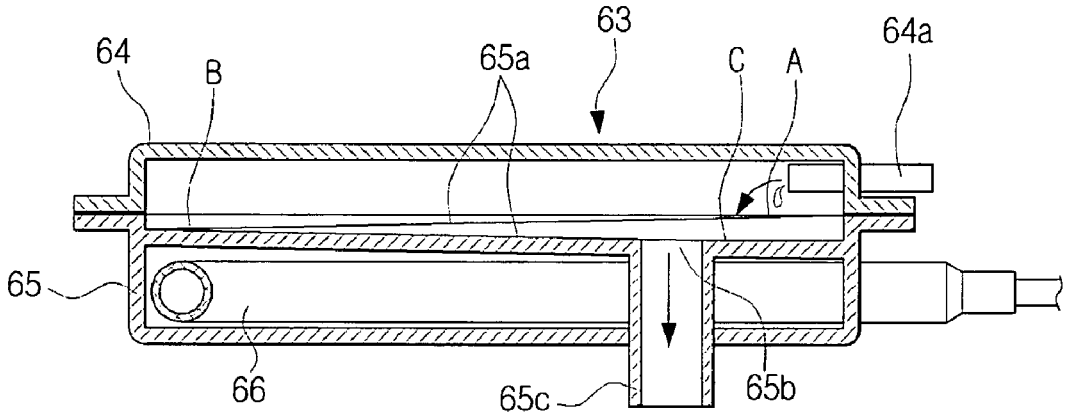
FIG. 7A is a plan view of a heater unit illustrated in FIG. 2.
Figure 7B:
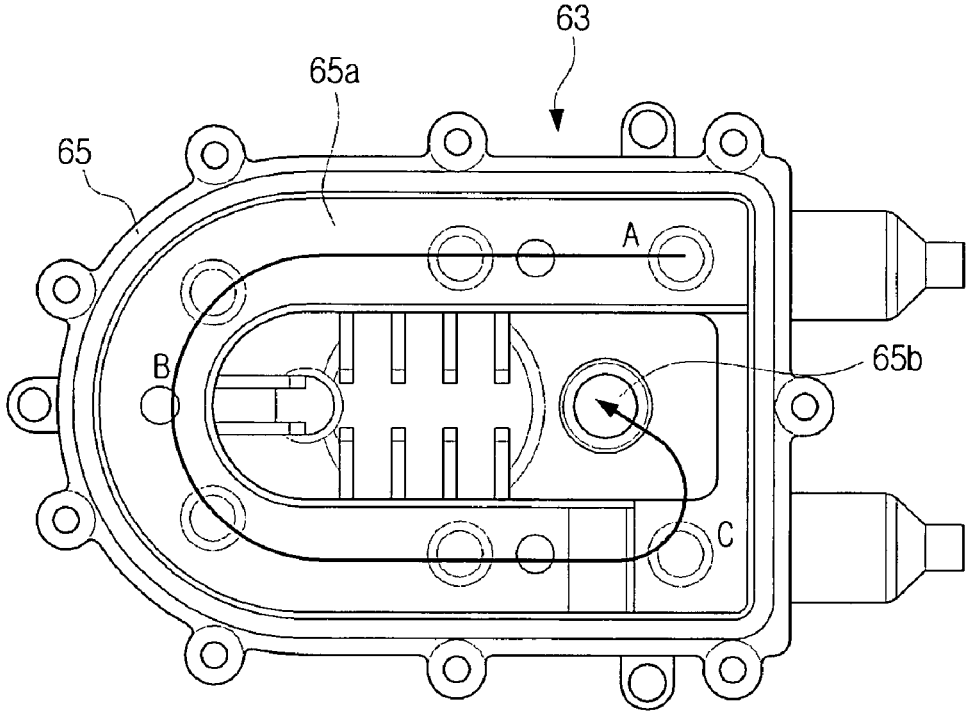
FIG. 7B is a bottom view of a heater unit illustrated in FIG. 2.

Referring to FIGS. 1, 2, and 6, the water storage tank 50 has a transparent window 51 installed thereon so that a user can grasp the amount of water remaining in the water storage tank 50, while the water storage tank is mounted in accommodating groove 14. A discharge port 53 for discharging the water stored in the water storage tank 50 projects from a part of the bottom surface of the water storage tank 50. The discharge port 53 is inserted into a docking protrusion 15*a* fixed to the lower main body 13, and a connection protrusion 15*b* projectingly formed in the docking protrusion 15*a* is inserted into the discharge port 53. Accordingly, the water stored in the water storage tank 50 is supplied to the micro-pump 61 through a first pipe 62.

In addition, the water storage tank 50 is locked or unlocked by a locking unit 17 formed on a rear wall 14*c* of the accommodating groove 14 when it is mounted in the accommodating groove 14. The locking unit 17 comprises a latch 17*a*, a coil spring 17*b*, and a slide button 17*c*. In this case, a front end of the latch 17*a* penetrates the rear wall 14*c* of the accommodating groove 14, and its rear end is resiliently supported by the coil spring 17*b* of which one side is supported by a support wall 11*a* formed inside the upper main body 11.

The slide button 17*c* is arranged outside the upper main body 11 for user's easy manipulation, and is movable along a sliding groove 11*b*. The slide button 17*c* is connected to a part of the latch 17*a*, and inserts/separates the latch 17*a* into/from a hook groove 54 formed on the rear part of the water storage tank 50 to lock/unlock the water storage tank 50 in/from the accommodating groove 14.

Referring to FIGS. 1, 2, 7A and 7B, the steam generating unit 60 comprises the micro-pump 61 and a heater unit 63. As described above, the micro-pump 61 is connected to the water storage tank 50 through the first pipe 62, and pumps the water stored in the water storage tank 50 into the heater unit 63 through a second pipe 64.

The heater unit 63 generates steam by heating the water being supplied from the micro-pump 61, and sprays the generated steam toward the surface to be cleaned. The heater unit 63 comprises an upper case 64, a lower case 65, and a heater 66.

The upper case 64 is detachably coupled to the lower case 65, and the upper case 64 and the lower case 65 cover the heater 66 to protect the heater 66. The upper case 64 has an inflow tube 64*a* installed therethrough to supply the water transferred from the micro-pump 61 to the heater unit 63. The front end of the inflow tube 64*a* that penetrates the upper case 64 extends to a position corresponding to a water supply point A (See FIG. 7A) of a "U"-shaped guide groove 65*a* of the lower case 65 to be explained later. Accordingly, a small amount of water flowing into the heater unit 63 through the inflow tube 64*a* is always supplied to a fixed position, i.e., the water supply point A.

In the lower case 64, the "U"-shaped heater 66, which corresponds to the "U"-shaped guide groove 65*a*, is arranged under the "U"-shaped guide groove 65*a* that has a specified width. The "U"-shaped guide groove 65*a* is continuously inclined downward, passing through the water supply points A, B, and C. Accordingly, the water supplied to the water supply point A through the inflow tube 64*a* is instantaneously heated by the "U"-shaped heater 66 that corresponds to the "U"-shaped guide groove 65*a* as the water flows from the point A to the point C along the "U"-shaped guide groove 65*a*. In addition, a spray hole 65*b* for guiding the steam to an outside is formed on a part adjacent to the point C of the "U"-shaped guide groove 65*a*, and a spray nozzle 65*c* connected to the spray hole 65*b* is formed on the outer part of the lower case 65.

The temperature control device 81 may be implemented by a positive temperature coefficient (PTC) thermistor of which the resistance value is increased as the temperature is heightened. The temperature control device 81, as shown in FIG. 8A, is electrically connected to a power line (not shown) connected to the heater unit 63, and serves to sense the temperature of the heater unit 63 and to interrupt the power being supplied to the heater unit 63 if the sensed temperature is higher than a predetermined temperature.

Figure 8A:
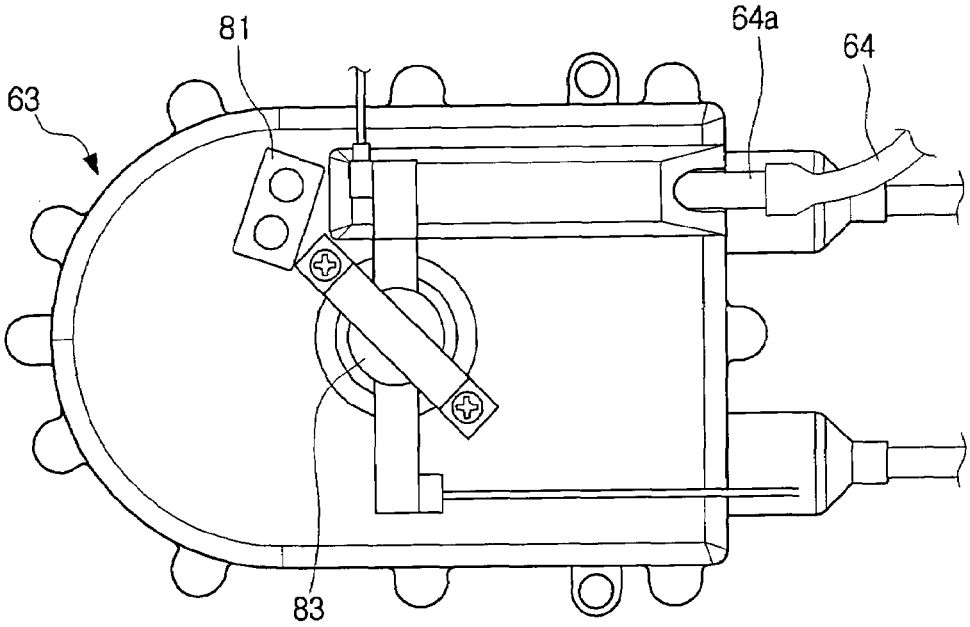
FIG. 8A is a side sectional view of a heater unit illustrated in FIG. 2.
Figure 8B:
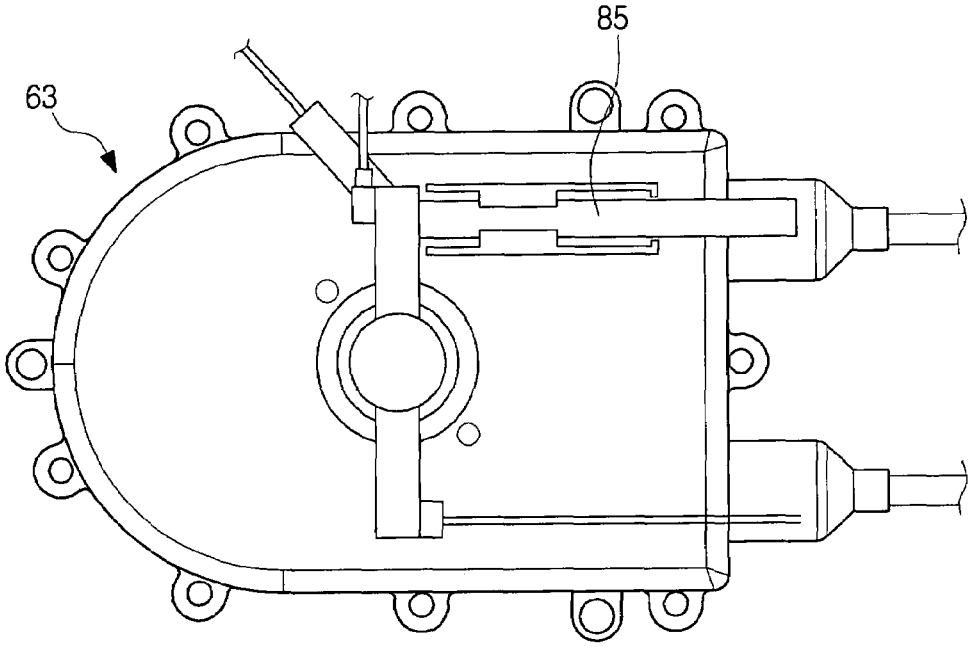
FIG. 8B is a plan view illustrating a heater unit with its upper housing and a heater removed as illustrated in FIG. 2.

The overheat preventing device 83, as shown in FIG. 8A, is electrically connected to the power line connected to the heater unit 63, and serves as a safety device that uses a bimetal and takes the place of the temperature control device 81 when the temperature control device 81 is out of order.

The temperature fuse 85, as shown in FIG. 8A, is electrically connected to the power line connected to the heater unit 63, and serves to intercept the power being supplied to the heater unit 63 so as to prevent the overheat of the heater unit 63 when both the temperature control device 81 and the overheat preventing device 83 are out of order.

According to the present disclosure, there are provided a microcomputer (not illustrated) and a sensor (not illustrated) for sensing the existence/nonexistence of the water in the water storage tank 50 or the first pipe 62, and if the temperature control device 81, the overheat preventing device 83, and the temperature fuse 85 are all out of order, the power supply to the heater unit 63 is finally intercepted to protect the heater unit 63 in multiple stages.

As described above, according to the present disclosure, the duster rotating plates are separated from the brush main body by one touch, and thus a user can easily detach or replace the dusters.

Also, since a part of the water storage tank is made of a transparent material, the user can easily grasp the amount of water remaining in the water storage tank, and thus can easily recognize a water supplement time.

In addition, since the water is instantaneously heated as a small amount of water is continuously supplied to the heater unit by the micro-pump, the preheating time can be reduced in comparison to the conventional water tank heating type cleaner. Since no water remains in the heater unit with the end of the steaming, fur forming due to the remaining water is prevented, and the steam spray nozzle of the heater unit is prevented from being clocked due to the fur.

In addition, the damage of a product or the occurrence of fire due to the overheat of the heater unit can be safely prevented in multistage through a plurality of safety devices installed in the heater unit.

The foregoing embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A suction brush of a vacuum cleaner for both vacuum cleaning and steam cleaning, comprising:

a brush main body connected to a cleaner main body;

a steam generating unit heating water being supplied from a water storage tank mounted on the brush main body and spraying steam generated by heating the water on a surface to be cleaned;

a turbine fan, installed in the brush main body, generating a rotating force by drawn-in air that flows into the brush main body;

a power transfer unit driven by the rotating force of the turbine fan; and at least one pair of duster rotating plates, arranged on a lower part of the brush main body, the least one pair of duster rotating plate being rotated by power being transferred through the power transfer unit;

wherein each of the at least one pair of duster rotating plates has a part that is detachably attached to the power transfer unit to attach/detach a duster to/from a bottom surface of the duster rotating plate, wherein the steam generating unit comprises a micro-pump connected to the water storage tank, the micro-pump pumping the water stored in the water storage tank and a heater unit for steaming the water being supplied from the micro-pump by instantaneously heating the water and spraying the steam on the surface to be cleaned through a spray nozzle, and wherein the heater unit comprises an upper case having an inflow tube formed thereon to receive the water being supplied from the micro-pump and a lower case detachably coupled to the upper case and having a heater that is arranged under an instantaneous heating region of the heater unit to heat the water.

2. The suction brush of claim 1, wherein the at least one pair of duster rotating plates are arranged to project over a rear outer part of the brush main body.

3. The suction brush of claim 1, wherein the power transfer unit comprises:

a pair of worm gears extendingly formed on both sides of a shaft of the turbine fan; and worm wheels meshed with the worm gears, respectively.

4. The suction brush of claim 3, wherein the pair of duster rotating plates are provided with a pair of coupling protrusions formed on their upper surfaces and detachably coupled to coupling holes formed on the pair of worm wheels.

5. The suction brush of claim 4, wherein outer peripheries of the pair of coupling protrusions comprise first and second non-slip parts having screw threads are formed thereon, respectively, and the coupling protrusions comprise third and fourth non-slip parts formed on inner peripheries of the coupling holes formed on the pair of worm wheels, respectively;

wherein the first and second non-slip parts are meshed with the third and fourth non-slip parts, respectively, when the coupling protrusions are coupled to the first and second worm wheels.

6. The suction brush of claim 4, wherein the coupling protrusions of the pair of duster rotating plates are made of an elastic material, and the coupling protrusions having a diameter is larger than a diameter of the coupling holes so that the pair of coupling protrusions are pressedly coupled to the coupling holes of the pair of worm wheels.

7. The suction brush of claim 1, wherein the water storage tank comprises a part made of a transparent material so that an interior of the water storage tank can be seen when the water storage tank is mounted on the brush main body.

8. The suction brush of claim 1, wherein the instantaneous heating region is formed to be continuously inclined downward as the water in the inflow tube flows from a water supply point to a water spray point by gravity.

9. The suction brush of claim 8, wherein the instantaneous heating region is formed as a "U"-shaped guide groove to secure the largest heating area corresponding to a size of the heater unit, and the heater is formed in a "U" shape along the instantaneous heating region.

10. The suction brush of claim 1, wherein the heater unit further comprises a temperature control device for interrupting a power being supplied to the heater unit if a sensed temperature of the heater unit is higher than a predetermined temperature.

11. The suction brush of claim 10, wherein the heater unit further comprises a bimetal device for preventing overheat of the heater unit when the temperature control device is out of order.

12. The section brush of claim 11, wherein the heater unit further comprises a temperature fuse for intercepting the power being supplied to the heater unit to prevent the overheat of the heater unit when the temperature control device and the overheat preventing device are out of order.

* * * * *